US012188186B2

(12) United States Patent
Pipol et al.

(10) Patent No.: US 12,188,186 B2
(45) **Date of Patent: *Jan. 7, 2025**

(54) SPIKE DRIVER CAB ENCLOSURE

(71) Applicant: S.W.N.G., Inc., Franklin Park, IL (US)

(72) Inventors: Justin J. Pipol, Hartland, WI (US); Daniel Henke, Brown Deer, WI (US)

(73) Assignee: S.W.N.G., Inc., Franklin Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/460,105

(22) Filed: Sep. 1, 2023

(65) Prior Publication Data

US 2023/0407576 A1 Dec. 21, 2023

Related U.S. Application Data

(63) Continuation of application No. 17/180,767, filed on Feb. 20, 2021, now Pat. No. 11,746,474, which is a continuation of application No. 16/001,217, filed on Jun. 6, 2018, now Pat. No. 10,927,509.

(60) Provisional application No. 62/516,197, filed on Jun. 7, 2017.

(51) Int. Cl.
*E01B 29/26* (2006.01)

(52) U.S. Cl.
CPC ..... *E01B 29/26* (2013.01)

(58) Field of Classification Search
CPC ..... E01B 29/16; E01B 29/17; E01B 29/24; E01B 29/26; E01B 29/32; E01B 33/00
See application file for complete search history.

(56) References Cited

U.S. PATENT DOCUMENTS

| | | | |
|---|---|---|---|
| 3,066,913 | A | 12/1962 | Leeson |
| 3,365,164 | A | 1/1968 | Engels |
| 3,405,649 | A | 10/1968 | Foxx et al. |
| 3,414,316 | A | 12/1968 | Stanley et al. |
| 3,426,698 | A | 2/1969 | Foxx et al. |
| 3,465,687 | A | 9/1969 | Kerns |
| 3,552,320 | A | 1/1971 | Traupmann |
| 3,635,164 | A | 1/1972 | Patton |
| 4,131,067 | A | 12/1978 | Newman et al. |
| 4,155,507 | A | 5/1979 | Chierici et al. |
| 4,273,052 | A | 6/1981 | Woolner et al. |
| 4,493,202 | A | 1/1985 | Stafford |
| 4,538,793 | A | 9/1985 | Dieringer et al. |
| 4,579,061 | A | 4/1986 | Dieringer |
| 4,874,518 | A | 10/1989 | Kirkland et al. |
| 5,191,840 | A | 3/1993 | Cotic et al. |
| 5,253,844 | A | 10/1993 | Cotic et al. |
| 5,487,341 | A | 1/1996 | Newman et al. |
| 5,542,355 | A | 8/1996 | Madison et al. |
| 6,095,053 | A | 8/2000 | Johnsen et al. |

(Continued)

OTHER PUBLICATIONS

Nordco, "Spike Puller Two Rail," [retrieved from the internet on Mar. 30, 2018 from URL: https://www.nordco.com/products-catalog/maintenance-of-way/Spike-Pulling-Machines/Spike-Puller-Two-Rail---SP2R.htm].

(Continued)

*Primary Examiner* — Robert J McCarry, Jr.
(74) *Attorney, Agent, or Firm* — Neal, Gerber & Eisenberg LLP

(57) ABSTRACT

A cab enclosure for a railroad spike driving machine to protect the operators from the environment includes a pair of pivoting railroad spike trays which can pivot up/down and left/right.

20 Claims, 5 Drawing Sheets

(56) References Cited

U.S. PATENT DOCUMENTS

| | | | | |
|---|---|---|---|---|
| 6,113,073 | A | 9/2000 | Lefavour et al. | |
| 6,974,087 | B2 | 12/2005 | Faichney | |
| 7,216,590 | B2 | 5/2007 | Eldridge et al. | |
| 7,353,757 | B2 | 4/2008 | Eldridge | |
| 8,485,103 | B2 | 7/2013 | Miller et al. | |
| 8,516,695 | B2 | 8/2013 | Zhao et al. | |
| 8,516,965 | B2 | 8/2013 | Pier et al. | |
| 8,857,344 | B2 | 10/2014 | Pier et al. | |
| 9,771,690 | B2 | 9/2017 | Henke | |
| 10,190,264 | B2 | 1/2019 | Hamilton et al. | |
| 11,746,474 | B2 * | 9/2023 | Pipol | E01B 29/26 104/17.1 |
| 2005/0081735 | A1 | 4/2005 | Hosking et al. | |
| 2006/0096399 | A1 | 5/2006 | Harper et al. | |
| 2009/0095188 | A1 | 4/2009 | Bounds | |
| 2018/0223482 | A1 | 8/2018 | Hamilton et al. | |
| 2018/0355559 | A1 | 12/2018 | Pipol et al. | |
| 2019/0010665 | A1 | 1/2019 | Vargas et al. | |
| 2020/0325635 | A1 | 10/2020 | Henke et al. | |
| 2020/0325636 | A1 | 10/2020 | Pipol et al. | |

OTHER PUBLICATIONS

Swingmaster, "SSPW Swingmaster Spike Puller Workhead," [retrieved from the internet on Jun. 18, 2019 from URL: http://www.swingmastercorp.com/wp-content/uploads/2018/09/SSPW-Brochure.pdf] (1 page).

The United States Patent and Trademark Office, International Search Report and Written Opinion in International Application No. PCT/US19/29934 (Jul. 19, 2019) (17 pages).

The United States Patent and Trademark Office, International Search Report and Written Opinion in International Application No. PCT/US19/58091 (Jan. 9, 2020) (5 pages).

The United States Patent and Trademark Office, International Search Report and Written Opinion in International Application No. PCT/US20/48811 (Nov. 24, 2020) (13 pages).

Youtube, 2nd Tie Spiker—14th Machine in CP Rail work gang, published Mar. 26, 2014, Link: https://www.youtube.com/watch?v=y-KqWCwyVeU.

* cited by examiner

SPIKE DRIVER CAB ENCLOSURE

CROSS REFERENCE TO RELATED APPLICATIONS

This application is a continuation of U.S. application Ser. No. 17/180,767, filed Feb. 20, 2021, which is a continuation of U.S. application Ser. No. 16/001,217, filed on Jun. 6, 2018, which claims the benefit of and priority to U.S. Provisional Application No. 62/516,197, filed on Jun. 7, 2017. These applications are incorporated by reference herein in their entirety.

TECHNICAL FIELD

The present disclosure relates to railroad spike driving equipment and, more particularly, and without limitations, the present disclosure relates to modifications designed to protect the machine operators from the environment.

BACKGROUND

The typical railroad spike driving machine currently has an open operator cab with two relatively large openings in the front revealing the adjacent spike driving units. The operator cab is open to the environment by these two relatively large openings in front of the spike handling workheads which allow for the spike trays to be loaded from inside of the cab during complete workhead movement. The openings are required for transportation of the generally vertically aligned spikes from the bulkbin to the spike driving units in front. A typical railroad spike holding tray for a spike driving machine has a fixed angle and moves directly with the spike driving workheads. This configuration generally precludes the operator cab openings from being reduced in size and thus increasing the operators' exposure to the environment (cold, heat, rain, snow, etc.) and also outside noise and dust which may be hazardous to the health of the operators. The present invention includes two enclosures mounted on the relatively large openings on the front of the spike driving machine. The enclosures are generally transparent and each are designed with two relatively small openings to which four pivoting spike trays extend. The enclosures greatly improve the air conditioner, heating, and cab pressure effectiveness and generally eliminate the need for operators to wear respirators. The quick change cab enclosure windows protect the operators from the outside environmental hazards and noise and can be field installed with minimal modifications to the existing machines. A prior art railroad spike driving machine is shown at https://www.youtube.com/watch?v=y-KqWCwyVeU. Youtube videos qualify as prior art. See HVLPO2, LLC v. Oxygen Frog, L L C, et al., 4-16-cv-00336 (FLND 2018-05-28, Order) (Mark E. Walker). Prior art spiking machines are shown in U.S. Pat. Nos. 5,191,840; 5,487,341; 4,493,202; and 8,857,344.

SUMMARY OF THE INVENTION

The object of the invention is to provide a system and method to reduce the environmental exposure to the operator(s) of the spike driving machine in operation. In particular, the two large openings in the front of the spike driving machine are substantially reduced in size by the use of a transparent window or shield which provides visibility for the operators. Each window has two relatively small openings which allow the spike trays to deliver the spikes to the spike handling workheads which drive the spikes into the ties. The spike trays can be manually loaded from the inside of the cab by the operator and deliver the spikes to the adjacent workheads. The spike handling trays 20 and 22 are moveable so that the vertical pivot of the spike trays maximizes the distances between the operator's knees and the inner end of the spike tray and the horizontal pivot and offset of the spike trays improves visibility of the work area over traditional spike trays.

BRIEF DESCRIPTION OF THE DRAWINGS

Exemplary embodiments are illustrated in the referenced drawings. It is intended that the embodiments and figures disclosed herein are to be considered illustrative rather than restrictive.

DETAILED DESCRIPTION OF THE PREFERRED EMBODIMENT

Figure 1:
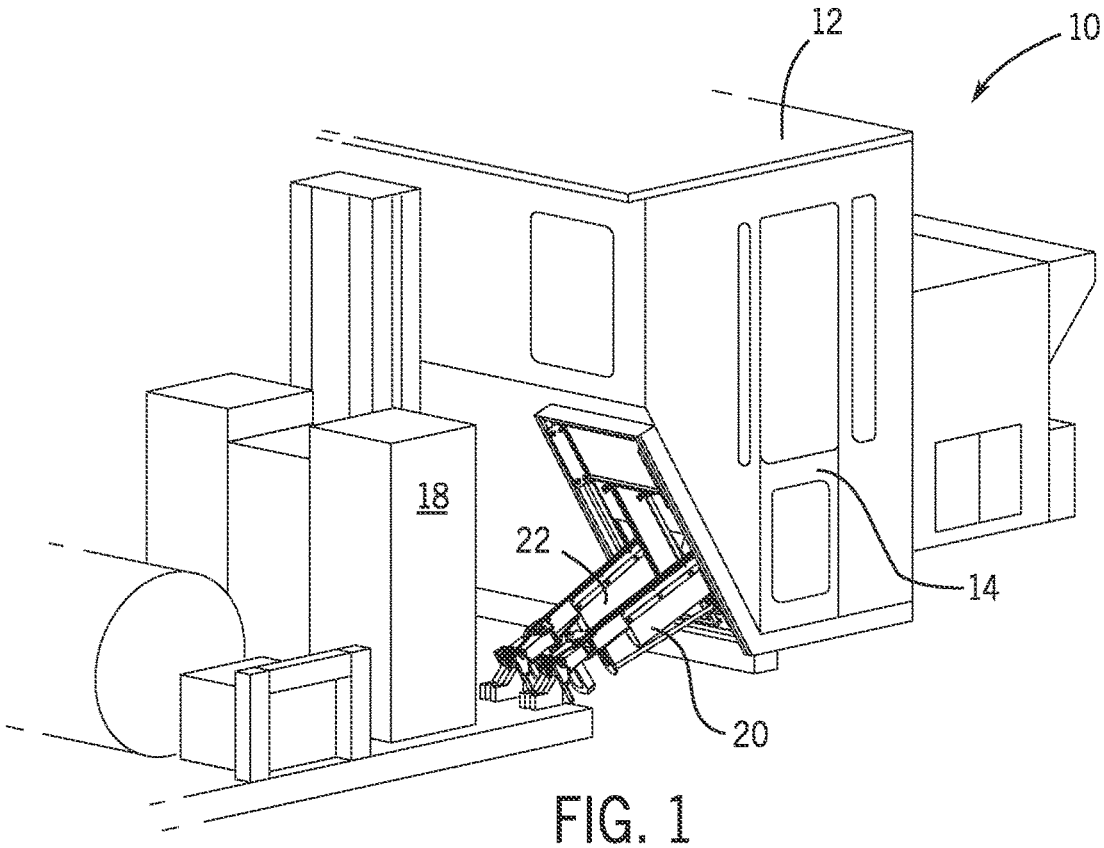
FIG. 1 is a perspective schematic view of a currently available spiker cab enclosure.
Figure 2:
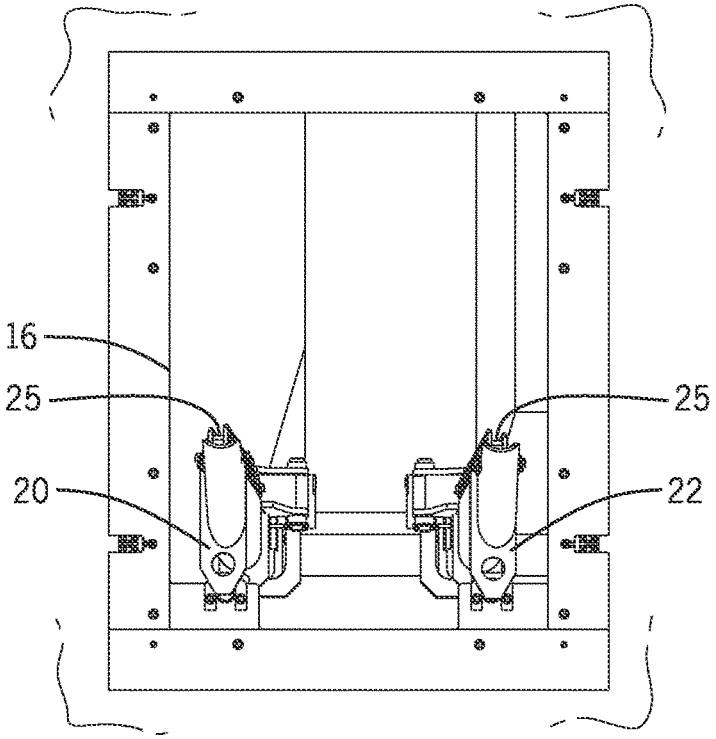
FIG. 2 is the operator's view of the spike trays from inside the cab.
Figure 3:
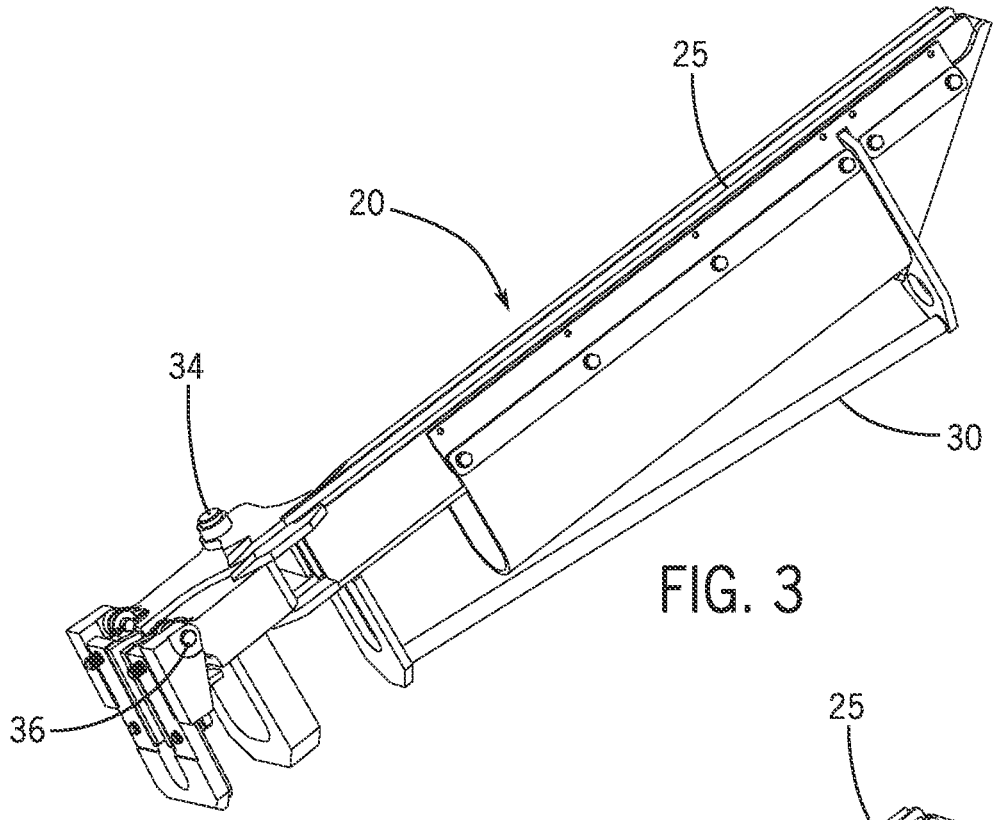
FIG. 3 is a perspective view of the left spike tray assembly.
Figure 4:
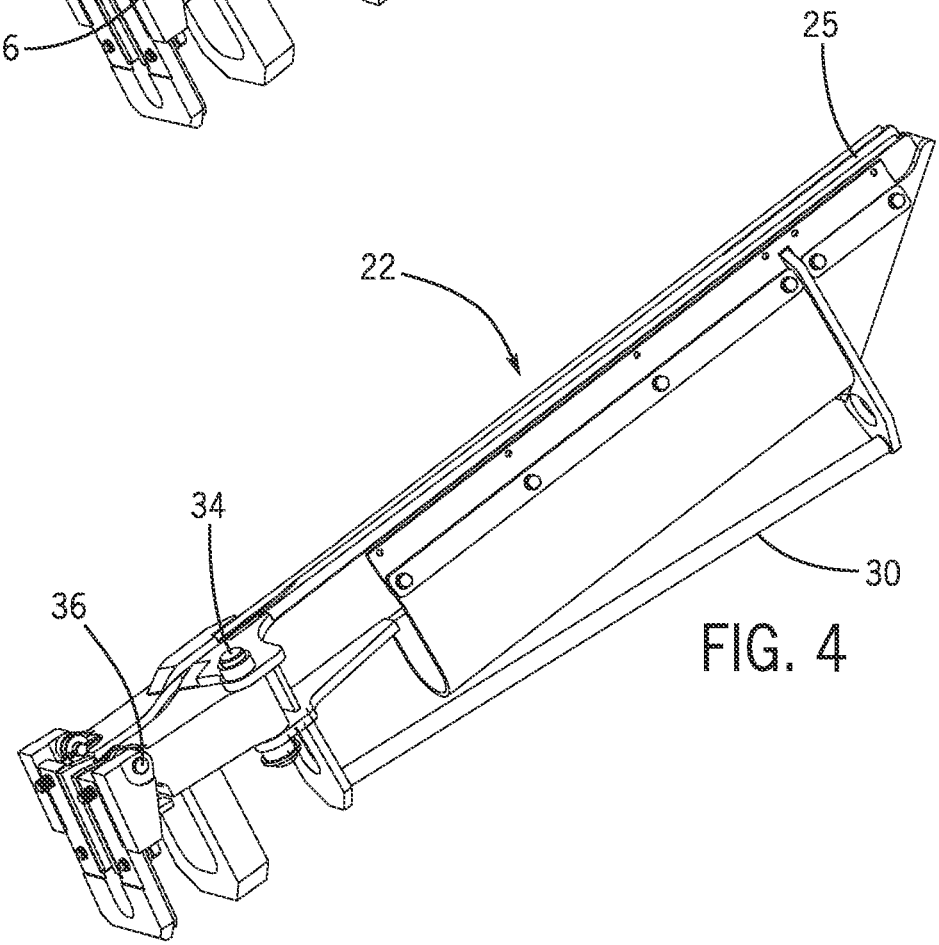
FIG. 4 is a perspective view of the right spike tray assembly.

FIG. 1 is a generally schematic, perspective view showing the design of a railroad spike driving machine, generally designated 10 in FIG. 1. Many commercially available spike driving machines can be adapted for use with the present invention. Personnel operating the spike driving machine ride within a cab 12 which is accessible through a door 14. On the front side of the cab, there are two generally large, rectangular openings 16 as shown in FIG. 2. A pair of pivoting spike trays 20 and 22 as shown in FIGS. 3 and 4 extend from the cab 12 through the aperture 16 toward a spike driving unit/workhead 18 in front of the cab. The cab 12 and the spike driving unit 18 are mounted on the railroad tracks and move along the tracks to drive the spikes into the ties.

The spike trays 20 and 22 are shown in more detail in FIGS. 3 and 4. Each spike tray includes a slot 25 on the top for manually loading the spikes in a generally vertical orientation from within the cab 12. The slots 25 are less than the width of the spike heads so that the spikes slide down the track toward the distal end to the spike driving unit/workhead. In a typical installation, there are two outside pivot trays 20 as shown in FIGS. 2 and 3 and two inside pivot trays 22 as shown in FIGS. 2 and 4 to allow for a full range of motion of the spike driving unit and transportation of the spikes downwardly from the cab.

Figure 5:
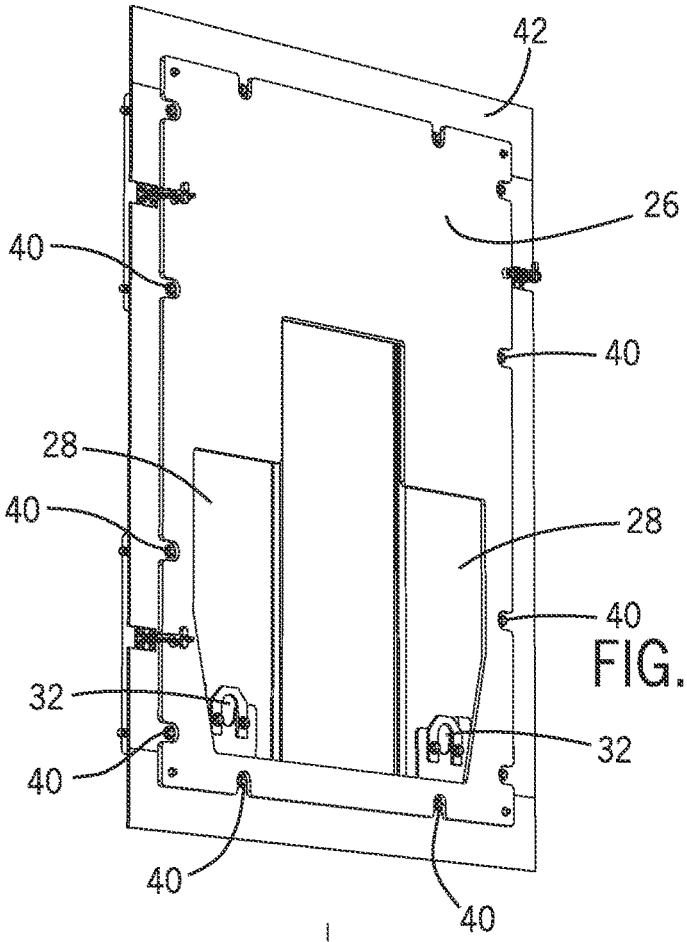
FIG. 5 is a perspective view of the enclosure shield assembly.

More particularly, a translucent or transparent panel 26 as shown in FIG. 5 is provided to close off the large opening 16 in the front of the cab and the transparent design is preferred to maintain visibility of the spike driving unit by the operator. The plastic shield 26 which provides the enclosure for most of the opening 16 can be made of any suitable, tough material. In order to permit delivery of the spikes to the slots 25 in the spike trays 20 and 22, each of the two shields 26 has a pair of openings 28 through which the spike trays extend to the spike trays, two apertures 28 are provided in the shield 26. As can be seen in the operator's view of FIG. 7, the operator can load the spikes into the slots 25 from inside the cab. In this way the shield 26 substantially cuts off the environment from the interior portion of the cab 12 preventing dust and other hazards from entering the cab.

Figure 6:
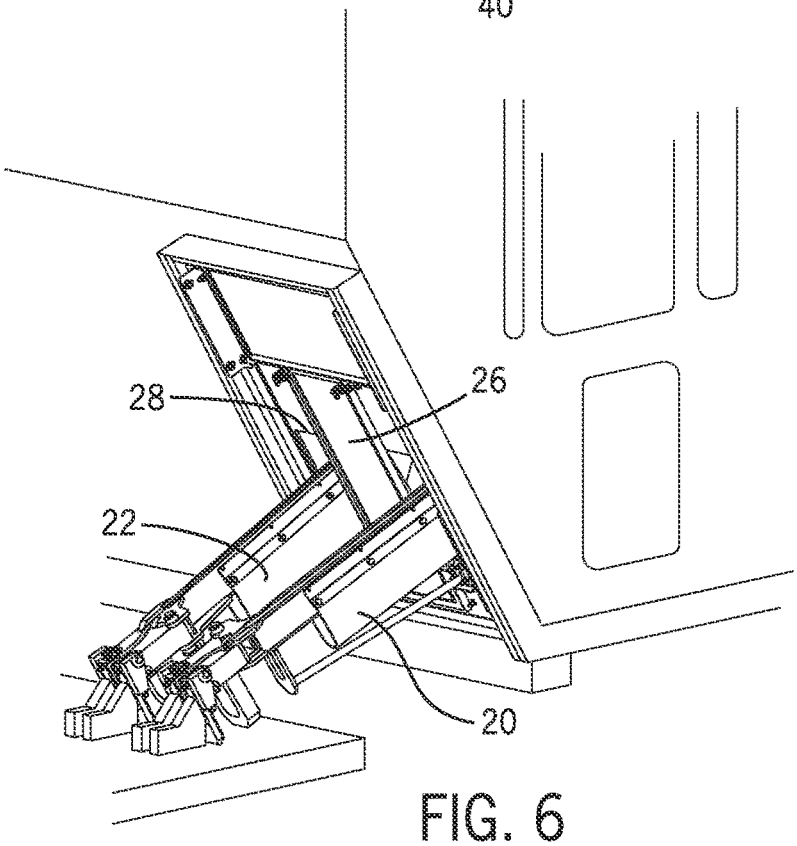
FIG. 6 is a close up perspective view of one side of the cab enclosure.
Figure 8:
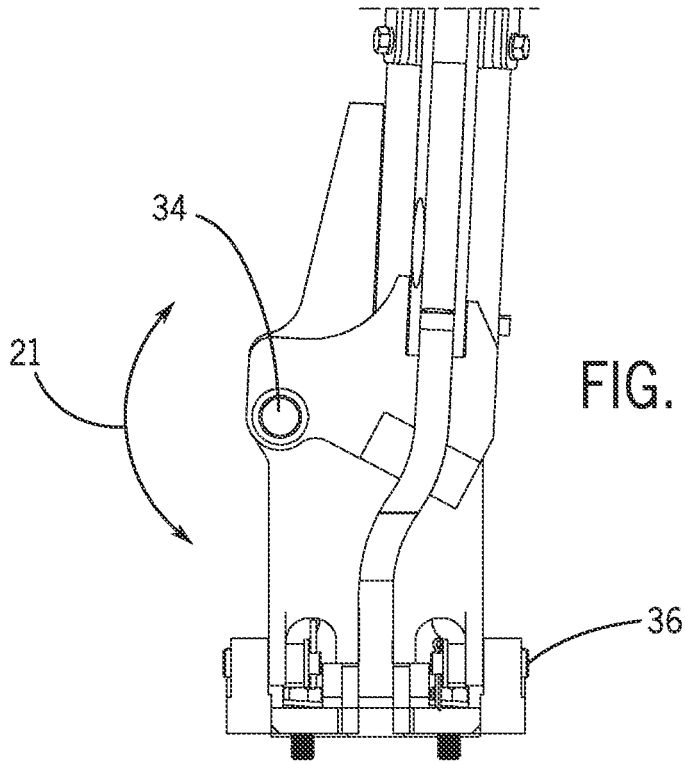
FIG. 8 is top view of the distal end of the spike tray showing the left/right pivot of the spike tray head.
Figure 9:
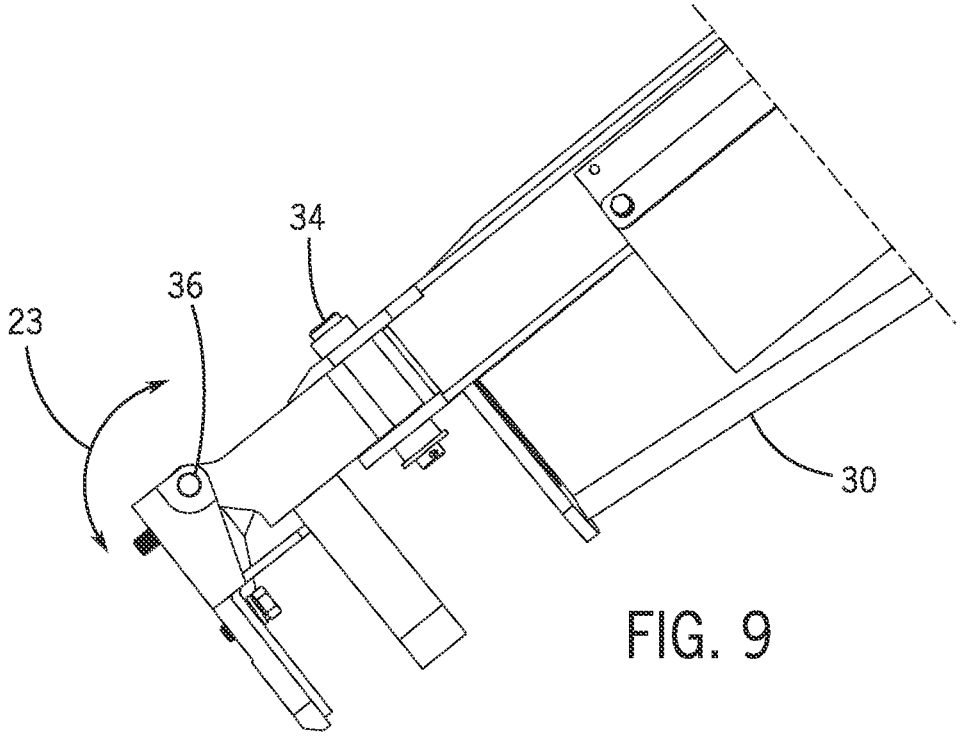
FIG. 9 is a side view of the distal end of the spike tray showing the up and down pivot of the spike tray head.

As can be seen in the enlarged view of FIG. 6, the two spike trays extend through the apertures 28 at an angle that permits the spikes to travel downwardly in the respective slots 25 to the lower, distal end of each one of the spike trays. Referring to FIGS. 3 and 4, each one of the spikes trays are guided by a single guidance rod 30 that is captured at the bottom of each opening 28 within an aperture 32. The aperture 38 and the rods 30 permit the spike trays to pivot upwardly and downwardly as desired by the operator. FIG. 8 shows a pair of arcuate arrows 21 showing the spike tray left to right pivot from above about the pivot point 34 around a vertical axis. FIG. 9 shows the same pivoting spike tray in a side elevation where the horizontal pivot point 36 permits rotation as shown by the arrows 23. The pivot about the pivot point 34 allows the tray to pivot each way from center which allows the spike tray to stay in the same spot relative to the cab enclosure during left and right movement of the spike driving unit. In FIG. 9, the side view, the pivot point allows the tray to pivot each way as shown by the arrow 23 allowing the spike tray to stay in the same spot relative to the cab enclosure during fore and aft movement of the spike driving unit.

Figure 7:
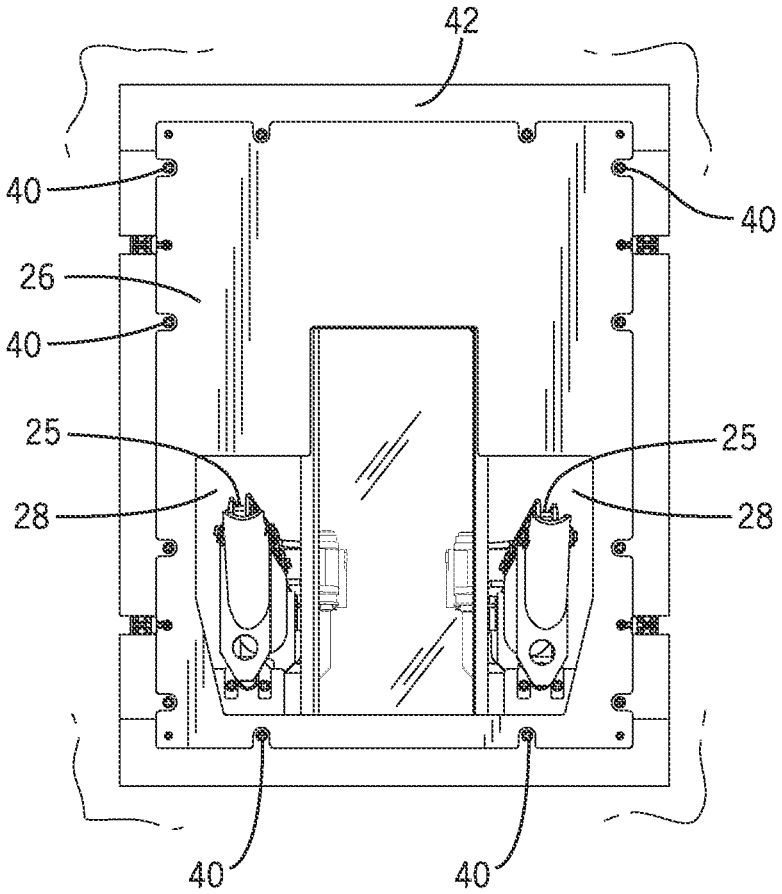
FIG. 7 is the operator's view of the spike trays with the shield installed.

In this way, the shield enclosure 26 protects the operators from the environment while the smaller apertures 28 allow the pivoting spike trays to deliver the spikes to the spike driving unit 18. As can be seen in FIGS. 5 and 7, the shield 26 is held in position by a plurality of peripheral screws or bolts 40 attached to a generally rectangular frame 42.

The operating manual for the spike driving machine of the present invention in conjunction with the spike driving workheads is shown in detail at https://drive.google.com/folderview?id=OBwzQVB1oqSdaHl4djBjRjEONkU. Also, a video file of the spike driving unit 14 moving along the railroad tracks with the workhead is shown in the file IMG_0746.MOV.

The foregoing detailed description has been given for clearness of understanding only and no unnecessary limitations should be understood therefrom.

The invention claimed is:

1. A panel assembly for a cab enclosure configured to shield an operator of a railroad spike driving machine, the panel assembly comprising:

a frame configured to attach to a front side of the cab enclosure;

a panel having a perimeter fastened to the frame, the panel defining an inset panel disposed between first and second openings configured to receive respective first and second spike trays of the railroad spike driving machine therethrough, and first and second reinforced apertures positioned adjacent to a bottom of the respective first and second openings, wherein the first and second reinforced apertures are configured to receive respective first and second guide rods of the respective first and second spike trays to enable pivotal movement of the respective first and second spike trays.

2. The panel assembly of claim 1, wherein the frame is rectangular.

3. The panel assembly of claim 1, including a plurality of screws or bolts configured to fasten the panel to the frame.

4. The panel assembly of claim 1, wherein the panel is transparent or translucent to enable the operator to view the first and second spike trays.

5. The panel assembly of claim 1, wherein the panel is plastic.

6. The panel assembly of claim 1, wherein the panel is configured to protect the operator from the environment.

7. The panel assembly of claim 1, wherein the first opening is configured to permit the first spike tray to pivot upwardly and downwardly, and wherein the second opening is configured to permit the second spike tray to pivot upwardly and downwardly.

8. The panel assembly of claim 7, wherein the first reinforced aperture is configured to receive the first guide rod such that the first spike tray is permitted to pivot upwardly and downwardly in the first opening, and wherein the second reinforced aperture is configured to receive the second guide rod such that the second spike tray is permitted to pivot upwardly and downwardly in the second opening.

9. A railroad spike driving machine, comprising:

a workhead configured to drive spikes into ties;

first and second spike trays configured to deliver the spikes to the workhead, wherein the first and second spike trays include respective first and second guide rods that enable pivotal movement of the respective first and second guide rods;

a cab having an operator side; and a panel assembly to shield an operator in the cab, the panel assembly comprising:

a frame at the operator side of the cab;

a panel having a perimeter fastened to the frame, the panel defining first and second openings configured to receive respective first and second spike trays of the railroad spike driving machine therethrough, and first and second apertures positioned adjacent to a bottom of the respective first and second openings, wherein the first and second apertures receive the respective first and second guide rods to enable pivotal movement of the respective first and second spike trays.

10. The railroad spike driving machine of claim 9, wherein the workhead is outside of the cab.

11. The railroad spike driving machine of claim 9, wherein the first and second pivoting spike trays extend from the cab, through the respective first and second openings, and to the workhead.

12. The railroad spike driving machine of claim 9, wherein the first and second pivoting spike trays includes a slot for manually loading the spikes in a vertical orientation from the cab.

13. The railroad spike driving machine of claim 9, further comprising a door configured to enable the operator to access the cab.

14. The railroad spike driving machine of claim 9, including a second panel assembly positioned laterally from the panel assembly to shield a second operator.

15. The railroad spike driving machine of claim 9, wherein the frame is rectangular.

16. The railroad spike driving machine of claim 9, wherein the panel assembly further comprises a plurality of screws or bolts configured to fasten the panel to the frame.

17. The railroad spike driving machine of claim 9, wherein the panel is transparent or translucent to enable the operator to view the first and second spike trays from the cab.

18. The railroad spike driving machine of claim 9, wherein the panel is plastic.

19. The railroad spike driving machine of claim 9, wherein the first opening of the panel is configured to permit the first spike tray to pivot upwardly and downwardly, and wherein the second opening of the panel is configured to permit the second spike tray to pivot upwardly and downwardly.

20. The railroad spike driving machine of claim 19, wherein the first aperture of the panel is configured to receive the first guide rod such that the first spike tray is permitted to pivot upwardly and downwardly in the first opening, and wherein the second aperture of the panel is configured to receive the second guide rod such that the second spike tray is permitted to pivot upwardly and downwardly in the second opening.

* * * * *